US005745040A

United States Patent [19]

Loughridge

[11] Patent Number: 5,745,040

[45] Date of Patent: Apr. 28, 1998

[54] OUTDOOR ALERTING DEVICE FOR SMOKE ALARMS

[76] Inventor: Lisa M. Loughridge, 1933 Apple St., Portage, Ind. 46368

[21] Appl. No.: 740,023

[22] Filed: Oct. 23, 1996

[51] Int. Cl.[6] ..... G08B 17/10

[52] U.S. Cl. ..... 340/628; 340/584; 340/691; 340/693; 367/199; 381/56

[58] Field of Search ..... 340/539, 577–579, 340/584, 628–630, 691–693; 367/197–199; 381/56–58

[56] References Cited

U.S. PATENT DOCUMENTS

| | | | |
|---|---|---|---|
| 4,189,720 | 2/1980 | Lott | 340/628 |
| 4,553,138 | 11/1985 | Nakanishi et al. | 340/584 |
| 4,612,535 | 9/1986 | Sequin et al. | 340/628 |
| 4,931,780 | 6/1990 | Lamont et al. | 340/691 |
| 4,935,952 | 6/1990 | Dutra | 340/628 |
| 5,012,223 | 4/1991 | Griebell et al. | 340/628 |
| 5,153,567 | 10/1992 | Chimento | 340/691 |
| 5,291,183 | 3/1994 | Chiang | 340/691 |
| 5,371,489 | 12/1994 | Carroll et al. | 340/565 |

*Primary Examiner*—Jeffey Hofsass
*Assistant Examiner*—Daniel J. Wu
*Attorney, Agent, or Firm*—Joseph N. Breaux

[57] ABSTRACT

An outdoor alerting device for smoke alarms including an alarm detecting and alerting device drive unit and an exterior alerting device including a loudspeaker installed within a housing and a light display unit attached to the housing and having a light bulb. The alarm detecting and alerting device drive unit includes an alarm detection circuit including a microphone having a microphone output in electrical connection with an amplifier circuit for converting the audible alarm into an amplified electrical microphone signal. The amplified electrical microphone signal is then passed through a band pass filter that is tuned to the main audible output frequency of the audible alarm of the smoke detector to produce a filtered microphone signal. The filtered microphone signal is the passed through a rectifier circuit to convert the filtered microphone signal into a DC microphone signal. The DC microphone signal is then output to the signal input of a comparator. The reference input of the comparator is supplied with a predetermined reference voltage such as through a voltage divider circuit. The output of the comparator is used to trigger the exterior alerting device after being passed through a delay network.

8 Claims, 2 Drawing Sheets

OUTDOOR ALERTING DEVICE FOR SMOKE ALARMS

TECHNICAL FIELD

The present invention relates to alerting devices and more particularly to an outdoor alerting device triggered by a smoke alarm having a mechanism for detecting activation of a smoke alarm within a building and an outdoor alerting device including an audible and a visual alerting mechanism for alerting individuals outside of a building when a smoke alarm within a building has been activated.

BACKGROUND OF THE INVENTION

Conventional smoke detecting devices typically have an audible alarm to warn the occupants of the building when a smoke alarm has been activated within the building. Although these alarms work fine to alert the occupants of the building, individuals outside of the building are often unable to detect the audible alarm output of the smoke detector and provide assistance to the occupants of the building. It would be desirable, therefore, to have an alerting device that could be triggered by a smoke detector within a building that would provide an audible and visual alerting mechanism exteriorly of the building to alert individuals outside of the building to an alarm condition within the building. This would be particularly useful in situations where a pot has been unattended on a stove by an individual who has stepped outside the building and then been distracted.

Because, it can be expensive to wire such an alerting device to one or more of the smoke detectors within a building it would be further desirable to have an outdoor alerting device that was triggered by a triggering circuit having detecting mechanism positionable within the building for detecting the presence of an audible alarm signal from any of the smoke detectors within the building. Also to prevent unduly arming neighbors and other individuals, it would be a further benefit to have such a triggering mechanism that included a delay mechanism for providing a predetermined delay period between detecting the presence of an audible alarm from a smoke detector and triggering the outdoor audio and visual alerting devices.

SUMMARY OF THE INVENTION

It is thus an object of the invention to provide an outdoor alerting device for smoke alarms that is triggered by a smoke detector within a building that provides an audible and visual alerting mechanism exteriorly of the building.

It is a further object of the invention to provide an outdoor alerting device for smoke alarms that is triggered by a triggering circuit having a detecting mechanism positionable within the building that detects the presence of an audible alarm signal from a smoke detector.

It is a still further object of the invention to provide an outdoor alerting device for smoke alarms that detects the presence of an audible alarm signal from a smoke detector that includes a delay mechanism for delaying activation of the outdoor alerting device for a predetermined period of time after detecting the presence of an audible alarm from a smoke detector.

It is a still further object of the invention to provide an outdoor alerting device for smoke alarms that accomplishes all or some of the above objects in combination.

Accordingly, an outdoor alerting device for smoke alarms is provided. The alerting device for smoke alarms includes an alarm detecting and alerting device drive unit and an exterior alerting device including an audible noise generating mechanism such as a loudspeaker installed within a housing and a light display unit attached to the housing and having a light bulb or other visual attraction mechanism installed therein. The alarm detecting and alerting device drive unit includes an alarm detection circuit including a microphone having a microphone output in electrical connection with an amplifier circuit for converting the audible alarm into an amplified electrical microphone signal. The amplified electrical microphone signal is then passed through a band pass filter that is tuned to the main audible output frequency of the audible alarm of the smoke detector to produce a filtered microphone signal. The filtered microphone signal is the passed through a rectifier circuit to convert the filtered microphone signal into a DC microphone signal. The DC microphone signal is then output to the signal input of a comparator. The reference input of the comparator is supplied with a predetermined reference voltage such as through a voltage divider circuit. The output of the comparator is then split and fed simultaneously into a first input of a first OR logic gate and the trigger input of a first retriggerable monostable multi-vibrator having a stable output period of a first predetermined length. The output of the first retriggerable monostable multi-vibrator is fed into a second input of the first OR logic gate. The output from the first OR logic gate is then split. One line from the output of the first OR gate is fed into the trigger input of a first non-retriggerable monostable multi-vibrator having a stable output period of a second predetermined length that is at least three times greater than the first predetermined length. The other line from the output of the first OR logic gate is fed into a delay network having a delay time between the input to the delay network and the output of the delay network that is greater than the time required for the first non-retriggerable monostable multi-vibrator to change output state at the complimentary output thereof and stabilize. The output of the delay network and the complementary output of the first non-retriggerable monostable multi-vibrator are then fed into separate inputs of an AND logic gate and the output of the AND logic gate fed into the trigger input of a second non-retriggerable, resettable, monostable multi-vibrator having a stable output period of a third predetermined length equal to the desired automatic reset period for the outdoor alerting device. The output of the second non-retriggerable, resettable, monostable multi-vibrator is fed to the control input of a power relay. The contacts of the power relay are wired in series between the speaker and the light bulb of the audible and visual alerting device. A momentary contact switch is wired to a reset input of the second non-retriggerable, resettable monostable multi-vibrator to allow the user to reset the alarm detecting and alerting device drive unit when desired.

In use the microphone detects audible noise and converts the audible noise into an electrical signal. The electrical signal is amplified and then fed through a band pass filter that strips of all but the signal corresponding to the frequency of the smoke detector alarm. The filtered signal is then converted into a DC voltage and then compared to a reference voltage by the comparator. If the comparator detects a signal voltage that is greater than the reference voltage then the circuit has detected that an audible smoke detector alarm is sounding. The reference voltage can be preset during manufacture of the circuit or an adjustable resister can be placed in the voltage divider circuit generating the reference voltage to allow the user to set the reference voltage after installation.

The first retriggerable monostable multi-vibrator and the first OR logic gate are used to filter out small interruptions in the output of the comparator that can be caused by for instance a fluctuating audible alarm output from the smoke detector or other source. The first non-retriggerable monostable multi-vibrator is used to provide the delay between detecting the audible alarm output from the smoke detector and triggering the outdoor alerting device. If the output from the OR logic gate remains at a high voltage longer than the second predetermined length of time than the alarm alerting device is triggered. The delay network is provided to assure that the complementary output of the first non-retriggerable monostable multi-vibrator has had a chance to change state and become stable at the input to the AND logic gate before the output from the OR logic gate is applied to the other input of the AND logic gate. Once the output from the AND logic gate goes high, the first non-retriggerable, resettable monostable multi-vibrator is triggered closing the power relay for a third preset length of time. This length of time is selected to be the desired outdoor alerting period before automatic reset. The automatic reset is provided to minimize undesirable long periods of operation that may be generated by a false alarm.

BRIEF DESCRIPTION OF DRAWINGS

For a further understanding of the nature and objects of the present invention, reference should be had to the following detailed description, taken in conjunction with the accompanying drawings, in which like elements are given the same or analogous reference numbers and wherein.

DESCRIPTION OF THE EXEMPLARY EMBODIMENT

Figure 1:
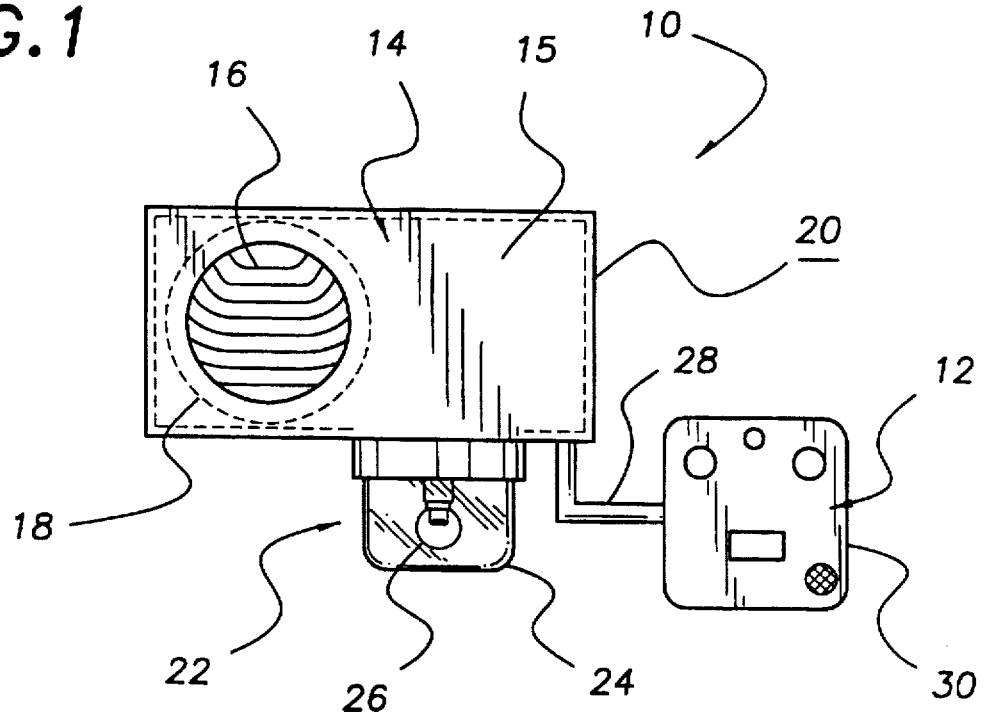
FIG. 1 is a plan view of an exemplary embodiment of the outdoor alerting device for smoke alarms of the present invention showing the alarm detecting and alerting device drive unit and the exterior alerting device including a loudspeaker installed within a housing and a light display unit extending from the housing.

FIG. 1 shows an exemplary embodiment of the outdoor alerting device for smoke alarms of the present invention generally designated by the numeral 10. Alerting device 10 includes an alarm detecting and alerting device drive unit, generally designated by the numeral 12, and an exterior alerting device, generally designated by the numeral 14. In this embodiment, exterior alerting device 14 includes a metal housing 15 having a loudspeaker grating 16 having a conventional loudspeaker 18 installed there behind within a compartment 20 formed within housing 15. A light display unit, generally designated 22, is attached to a bottom surface of housing 15 and includes a transparent dome 24 defining a bulb compartment having a light bulb 26 disposed therein. Light bulb 26 and loudspeaker 18 are each connected to alarm detecting and alerting device drive unit 14 through an electrical cable 28 running between housing 15 and a drive unit housing 30. Drive unit housing 30 houses an alarm detecting and alerting device drive unit circuit.

Figure 2:
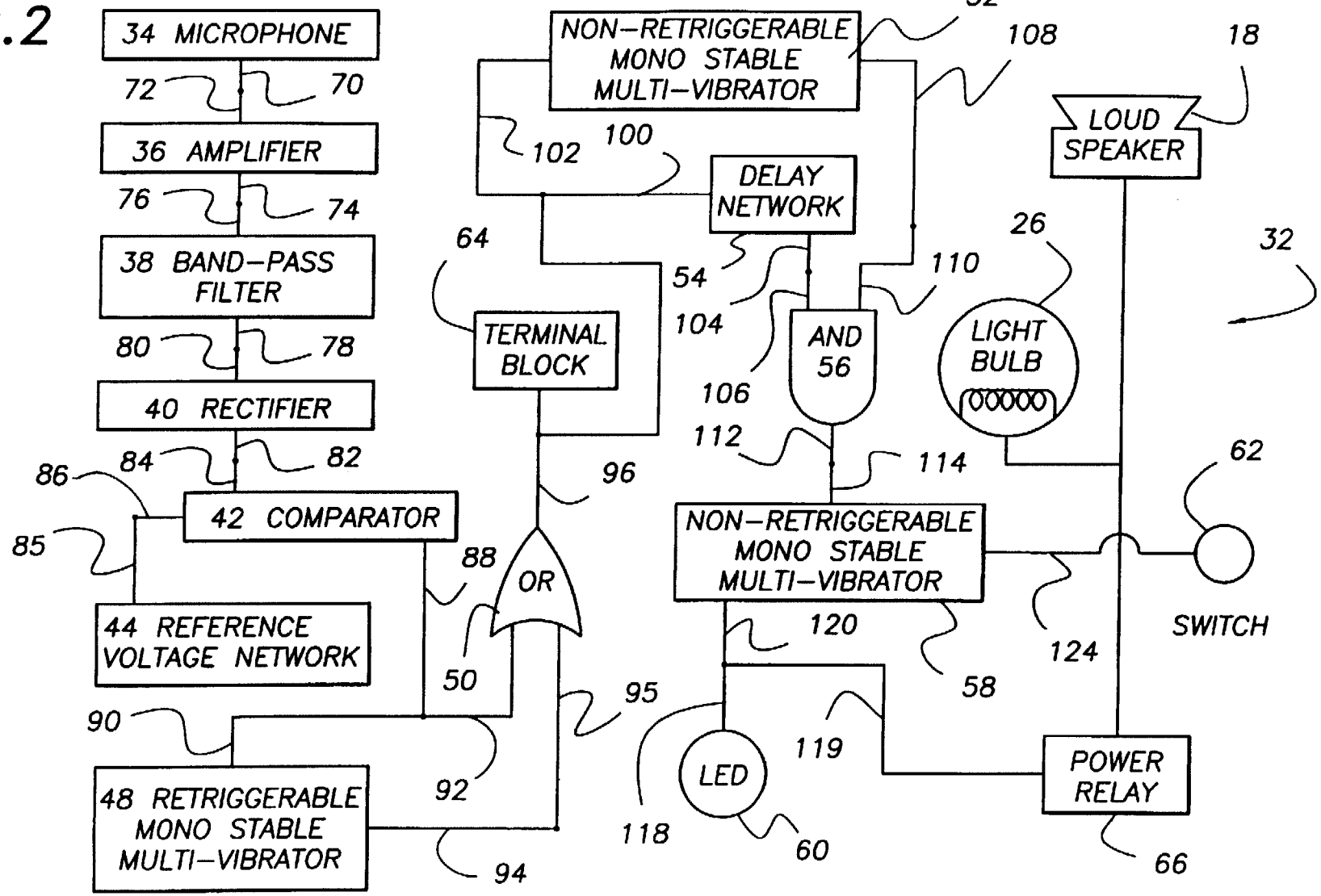
FIG. 2 is a schematic diagram showing a representative optional hard wired installation.

FIG. 2 shows a schematic diagram of an exemplary alarm detecting and alerting device drive unit circuit generally designated by the numeral 32. Alarm detecting and alerting device drive unit circuit 32 includes a microphone 34; an amplifier circuit 36; a band pass filter 38; a rectifier circuit 40; a comparator 42 including a reference voltage generating network 44; a first retriggerable monostable multi-vibrator 48; a first OR logic gate 50; a first non-retriggerable monostable multi-vibrator 52; a delay network 54; an AND logic gate 56; a second non-retriggerable, resettable, monostable multi-vibrator 58; a first light emitting diode 60; a momentary contact switch 62, a terminal block 64; and a power relay 66. Also shown schematically in the figure are loudspeaker 18 and light bulb 26.

Microphone 34 is a conventional microphone having a microphone output 70 in electrical connection with an amplifier input 72 of a conventional amplifier circuit 36. An amplifier output 74 of amplifier circuit 36 is in electrical connection with a filter input 76 of a conventional band pass filter 38. The pass band of band pass filter 38 is selected to be the bandwidth at which the greatest audible power is output from the smoke detector speaker.

A filter output 78 of band pass filter 38 is in electrical connection with a rectifier input 80 of a conventional rectifier circuit 40. Rectifier circuit 40 can be either a half-wave or a full wave rectifier. A rectifier output 82 of rectifier circuit 40 is in electrical connection with a signal input 84 of conventional comparator 42. In this embodiment, reference voltage generating network 44 is a conventional resistance voltage dividing network. The reference voltage output 85 generated by reference voltage generating network 44 is electrically connected to a reference voltage input 86 of comparator 42.

The comparator output 88 of comparator 42 is in electrical connection with a trigger input 90 of first retriggerable monostable multi-vibrator 48 and a first OR gate input 92 of first OR logic gate 50. First retriggerable monostable multi-vibrator 48 and first OR logic gate 50 are conventional integrated circuits. In this embodiment the stable output period first retriggerable monostable multi-vibrator 48 is preset to a first predetermined length of about one second. The multi-vibrator output 94 of first retriggerable monostable multi-vibrator 48 is electrically connected to a second OR gate input 95 of first OR logic gate 50.

Figure 3:
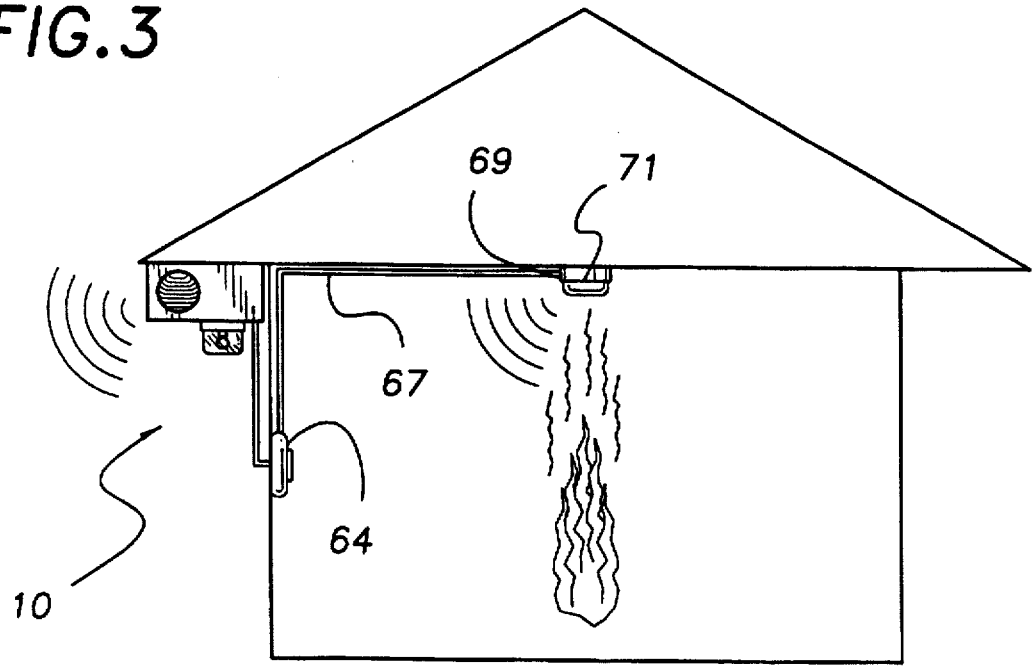
FIG. 3 is a schematic diagram of an exemplary alarm detecting and alerting device drive circuit.

The OR gate output 96 of first OR logic gate 50 is electrically connected to the delay input 100 of delay network 54 and the trigger input 102 of non-retriggerable, monostable multi-vibrator 52. Also connected to OR gate output 96 is a conventional wiring terminal block 64. Wiring terminal block 64 is utilized when it is desired to hard wire alarm detecting and alerting device drive unit circuit 32 to the alarm output of a smoke detector which will maintain OR gate output 96 at a high level even when the voltage level of signal input 92 is less than the voltage level of reference input 95. FIG. 3 shows an illustration of such an installation with a cable 67 run between terminal block 64 and an alarm output 69 of a conventional smoke detector 71.

Referring back to FIG. 2, the delay output 104 of delay network 54 is electrically connected to a first AND gate input 106 of first AND logic gate 56. The multi-vibrator output 108 of non-retriggerable, monostable multi-vibrator 52 is electrically connected to a second AND gate input 110 of AND logic gate 56. The stable output period of non-retriggerable, monostable multi-vibrator 52 is set for a predetermined length of about sixty seconds. Non-retriggerable, monostable multi-vibrator 52 and AND logic gate 56 are conventional integrated circuits.

The AND gate output 112 of AND logic gate 56 is electrically connected to the trigger input 114 of second non-retriggerable, resettable, monostable multi-vibrator 58. Second non-retriggerable, resettable, monostable multi-vibrator 58 is a conventional integrated circuit.

The multi-vibrator output 120 of second non-retriggerable, resettable, monostable multi-vibrator 58 is electrically connected to a first diode lead 118 of light emitting diode 60 and the control input 119 of a power relay 66. The stable output period of second non-retriggerable, resettable, monostable multi-vibrator 58 is set at about fifteen minutes. Light emitting diode 60 and power relay 66 are conventional components. Momentary contact switch 62 is a conventional momentary contact switch that is wired to the reset input 124 of second non-retriggerable, resettable, monostable multi-vibrator 58. Depressing momentary contact switch 62 causes second non-retriggerable, resettable, monostable multi-vibrator 58 to be reset. Closure of the contacts of power relay 66 energizes light bulb 26 and loudspeaker 18.

With general reference to FIGS. 1–3, alerting device 10 is installed by installing alarm detecting and alerting device drive unit 12 in a convenient location within the building and installing exterior alerting device 14 outside of the building under eve or other convenient location where light bulb 26 can attract attention when illuminated. Operation of alerting device 10 is as previously described.

It can be seen from the preceding description that an outdoor alerting device for smoke alarms has been provided that is triggered by a smoke detector within a building; that provides an audible and visual alerting mechanism exteriorly of the building; that is triggered by a triggering circuit having a detecting mechanism positionable within the building that detects the presence of an audible alarm signal from a smoke detector; and that includes a delay mechanism for delaying activation of the outdoor alerting device for a predetermined period of time after detecting the presence of an audible alarm from a smoke detector.

It is noted that the embodiment of the outdoor alerting device for smoke alarms described herein in detail for exemplary purposes is of course subject to many different variations in structure, design, application and methodology. Because many varying and different embodiments may be made within the scope of the inventive concept(s) herein taught, and because many modifications may be made in the embodiment herein detailed in accordance with the descriptive requirements of the law, it is to be understood that the details herein are to be interpreted as illustrative and not in a limiting sense.

What is claimed is:

1. An outdoor alerting device for smoke alarms comprising:

an alarm detecting and alerting device drive unit having a alarm detecting circuit for detecting an audible alarm from a smoke detector; and an exterior alerting device including a housing having an audible noise generating mechanism installed within a compartment formed within said housing, and a visual attraction mechanism in connection with said housing, said audible noise generating mechanism and said visual attraction mechanism being responsive to a signal from said alarm defecting and alerting device drive unit;

said alarm detecting circuit including:

a microphone, an amplifier circuit, a band pass filter, a rectifier circuit, a comparator including a reference voltage generating network, a first retriggerable monostable multi-vibrator, and a first OR logic gate;

said microphone having a microphone output in electrical connection with an amplifier input of said amplifier circuit;

said amplifier circuit having an amplifier output in electrical connection with a filter input of said band pass filter;

said band pass filter having a filter output in electrical connection with a rectifier input of said rectifier circuit;

said rectifier circuit having a rectifier output in electrical connection with a signal input of said comparator;

said reference voltage generating network having a reference voltage output in electrical connection with a reference voltage input of said comparator;

said comparator having a comparator output in electrical connection with a first trigger input of said first retriggerable monostable multi-vibrator and a first OR gate input of said first OR logic gate; and said first retriggerable monostable multi-vibrator having a first multi-vibrator output in electrical connection with a second OR gate input of said first OR logic gate.

2. The outdoor alerting device for smoke alarms of claim 1 wherein:

said alarm detecting circuit further includes:

a first non-retriggerable monostable multi-vibrator;

a delay network;

an AND logic gate; and a second non-retriggerable, resettable, monostable multi-vibrator; and wherein:

an OR gate output of said first OR logic gate is electrically connected to a delay input of said delay network and a second trigger input of said first non-retriggerable, monostable multi-vibrator;

a delay output of said delay network is electrically connected to a first AND gate input of said first AND logic gate; and a second multi-vibrator output of said non-retriggerable, monostable multi-vibrator is electrically connected to a second AND gate input of said AND logic gate.

3. The outdoor alerting device for smoke alarms of claim 2 wherein:

said AND logic gate has an AND gate output in electrical connection with a third trigger input of a second non-retriggerable, resettable, monostable multi-vibrator; and said second non-retriggerable, resettable, monostable multi-vibrator has a third multi-vibrator output in electrical connection with a power relay.

4. The outdoor alerting device for smoke alarms of claim 3 wherein:

said second non-retriggerable, resettable, monostable multi-vibrator has a reset input; and said alarm detecting circuit further includes a momentary contact switch in electrical connection with said reset input.

5. The outdoor alerting device for smoke alarms of claim 1 wherein:

a pass band of said band pass filter is selected to be the bandwidth at which the greatest audible power is output from a smoke detector speaker.

6. The outdoor alerting device for smoke alarms of claim 5, wherein:

said alarm detecting circuit further includes:

a first non-retriggerable monostable multi-vibrator;

a delay network;

an AND logic gate; and a second non-retriggerable, resettable, monostable multi-vibrator; and wherein:

an OR gate output of said first OR logic gate is electrically connected to a delay input of said delay network and a second trigger input of said first non-retriggerable, monostable multi-vibrator;

a delay output of said delay network is electrically connected to a first AND gate input of said first AND logic gate; and a second multi-vibrator output of said non-retriggerable, monostable multi-vibrator is electrically connected to a second AND gate input of said AND logic gate.

7. The outdoor alerting device for smoke alarms of claim 6 wherein:

said AND logic gate has an AND gate output in electrical connection with a third trigger input of a second non-retriggerable, resettable, monostable multi-vibrator; and said second non-retriggerable, resettable, monostable multi-vibrator has a third multi-vibrator output in electrical connection with a power relay.

8. The outdoor alerting device for smoke alarms of claim 7 wherein:

said second non-retriggerable, resettable, monostable multi-vibrator has a reset input; and said alarm detecting circuit further includes a momentary contact switch in electrical connection with said reset input.

* * * * *